US008028489B1

(12) United States Patent
Lawrence

(10) Patent No.: US 8,028,489 B1
(45) Date of Patent: Oct. 4, 2011

(54) FRAMED WINDOW SCREEN AND CONNECTOR

(76) Inventor: Barry G. Lawrence, Thomasville, NC (US)

( * ) Notice: Subject to any disclaimer, the term of this patent is extended or adjusted under 35 U.S.C. 154(b) by 0 days.

(21) Appl. No.: 12/683,464

(22) Filed: Jan. 7, 2010

(51) Int. Cl.
*E04C 2/38* (2006.01)

(52) U.S. Cl. ..... 52/656.7; 52/656.5; 52/204.57; 52/204.58

(58) Field of Classification Search ..... 52/656.7, 52/56.5, 656.9, 204.57, 204.58; 403/205, 403/295, 382, 403
See application file for complete search history.

(56) References Cited

U.S. PATENT DOCUMENTS

| | | | | | |
|---|---|---|---|---|---|
| 1,852,866 | A | * | 4/1932 | Weitzel | 160/381 |
| 2,776,735 | A | * | 1/1957 | Bancroft | 403/295 |
| 3,429,602 | A | * | 2/1969 | Dirilgen | 403/295 |
| 3,510,985 | A | * | 5/1970 | Smits | 49/425 |
| 3,782,054 | A | * | 1/1974 | Goss, Jr. | 403/295 |
| 3,784,043 | A | * | 1/1974 | Presnick | 220/4.28 |
| 4,205,486 | A | * | 6/1980 | Guarnacci | 49/501 |
| 4,240,765 | A | * | 12/1980 | Offterdinger | 403/402 |
| 4,438,578 | A | * | 3/1984 | Logan | 40/782 |
| 4,570,406 | A | * | 2/1986 | DiFazio | 52/656.9 |
| 4,924,649 | A | * | 5/1990 | Taylor | 52/656.9 |
| 4,993,866 | A | * | 2/1991 | Sugihara et al. | 403/402 |
| 5,431,211 | A | * | 7/1995 | Guillemet | 160/381 |
| 5,473,853 | A | * | 12/1995 | Guillemet et al. | 52/745.16 |
| 5,485,705 | A | * | 1/1996 | Guillemet | 52/656.9 |
| D411,018 | S | * | 6/1999 | Nowell | D25/61 |
| 6,047,514 | A | * | 4/2000 | Verch | 52/656.5 |
| 6,067,760 | A | * | 5/2000 | Nowell | 52/204.57 |
| 6,247,869 | B1 | * | 6/2001 | Lichvar | 403/205 |
| 6,672,365 | B2 | * | 1/2004 | Therrien | 160/369 |
| 7,223,044 | B2 | * | 5/2007 | Quintile | 403/402 |
| 7,559,180 | B2 | * | 7/2009 | Ajiki | 52/655.1 |
| 7,634,880 | B2 | * | 12/2009 | Sironko et al. | 52/456 |

* cited by examiner

*Primary Examiner* — Eileen D Lillis
*Assistant Examiner* — Alp Akbasli

(57) ABSTRACT

A framed window screen formed from four (4) rails which each include a channel, a wide groove and a narrow groove and are each cut at a forty-five degree (45°) angle at the terminal ends. A durable, sturdy corner connector joins each rail one to another, which may be molded from a durable polymeric material having an L-shaped member, a groove support and a stanchion. The groove support is V-shaped and joined to the L-shaped member by a rib. Each end of the L-shaped member of the connector is inserted into adjacent rail channels with the groove support positioned in the wide grooves of the adjacent rails. Once the screen frame is assembled using the connectors, a suitably cut screen wire can be placed over the frame with the edges proximate the narrow groove whereby a rubber seal is inserted to maintain the screen in the narrow groove by friction.

13 Claims, 8 Drawing Sheets

FRAMED WINDOW SCREEN AND CONNECTOR

FIELD OF THE INVENTION

The invention herein pertains to framed window screens as are used for house and other building windows and particularly pertains to a framed window screen made from extruded aluminum rails which are cut to size and assembled using an improved corner connector.

DESCRIPTION OF THE PRIOR ART AND OBJECTIVES OF THE INVENTION

Framed window screens are used today on most homes, office buildings, RV's, campers and other structures having windows which can be opened. Such framed window screens prevent insects, debris and the like from entering the building. Most framed window screens are made with relatively light weight aluminum rails which are cut on each end at forty-five degree (45°) angles and are joined using a connector at each corner to form a rectangular frame after which a standard wire or composite mesh is inserted and sealed to the frame. Such framed window screens are handled multiple times during assembly and later during installation. It is not unusual for the rails of the framed window screens to become loose or disjointed at the corners due to the connector. If this occurs during assembly then the framed window screen must be reassembled. If the joint loosens or breaks during installation at a job site, the framed window screen usually has to be replaced, causing additional expense, time and inconvenience.

Thus, in view of the problems and disadvantages of conventional framed window screens, the present invention was conceived and one of its objectives is to provide a more durable, rigid frame for containing the screen wire using an improved corner connector.

It is another objective of the present invention to provide an improved corner connector for use in forming a framed window screen which is durable and will maintain its integrity during adverse handling conditions.

It is yet another objective of the present invention to provide a framed window screen corner connector which can be easily and accurately inserted during assembly into the frame rails and which will provide greater strength and durability to the framed window screen.

Various other objectives and advantages of the present invention will become apparent to those skilled in the art as a more detailed description is set forth below.

SUMMARY OF THE INVENTION

The aforesaid and other objectives are realized by providing a framed window screen which utilizes an inexpensive corner connector at the joint between adjacent rails. The connector includes an L-shaped member for insertion into adjacent rail channels and a V-shaped groove support which is wider than the L-shaped member. The groove support frictionally engages the large grooves of the adjacent rails. A rib connects to and allows the V-shaped groove support to be spaced from the L-shaped member and a stanchion is provided at the terminal end of the rib to assist the connection between the adjacent rails and to make the connection seamless.

DETAILED DESCRIPTION OF THE PREFERRED EMBODIMENT AND OPERATION OF THE INVENTION

Figure 1:
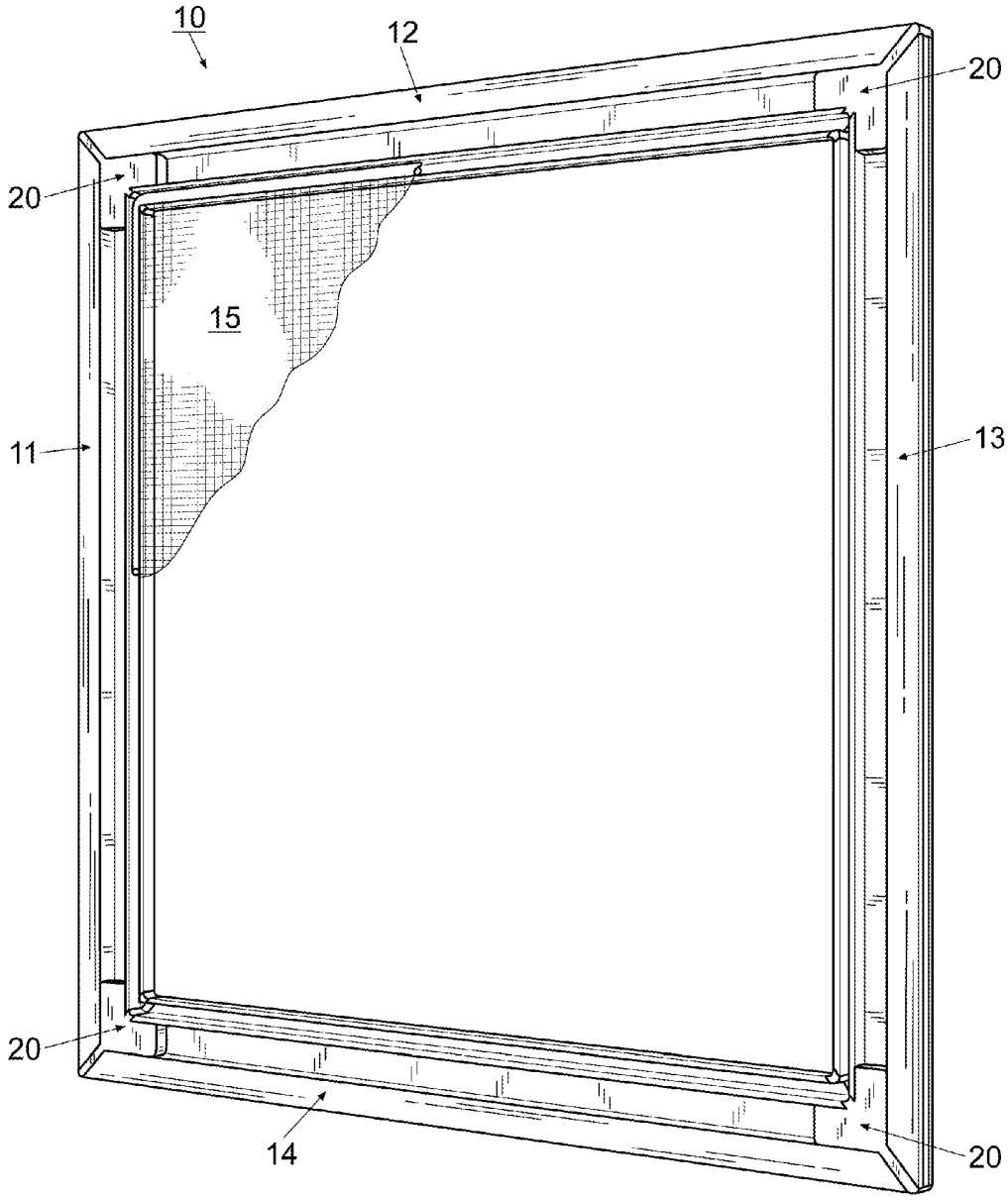
FIG. 1 is a rear perspective view of a framed window screen with corner connectors.

For a better understanding of the invention and its operation, turning now to the drawings, FIG. 1 shows preferred framed window screen 10 having first side rail 11, second top rail 12, third opposing side rail 13 and fourth bottom rail 14 joined together using four (4) corner connectors 20. Standard screen wire 15 is positioned therein. Screen wire 15 consists of a typical small mesh metal wire or polymeric screen. Framed window screen 10 is sized to fit typical windows such as in homes, buildings, mobile homes, RV's and the like.

Figure 2:
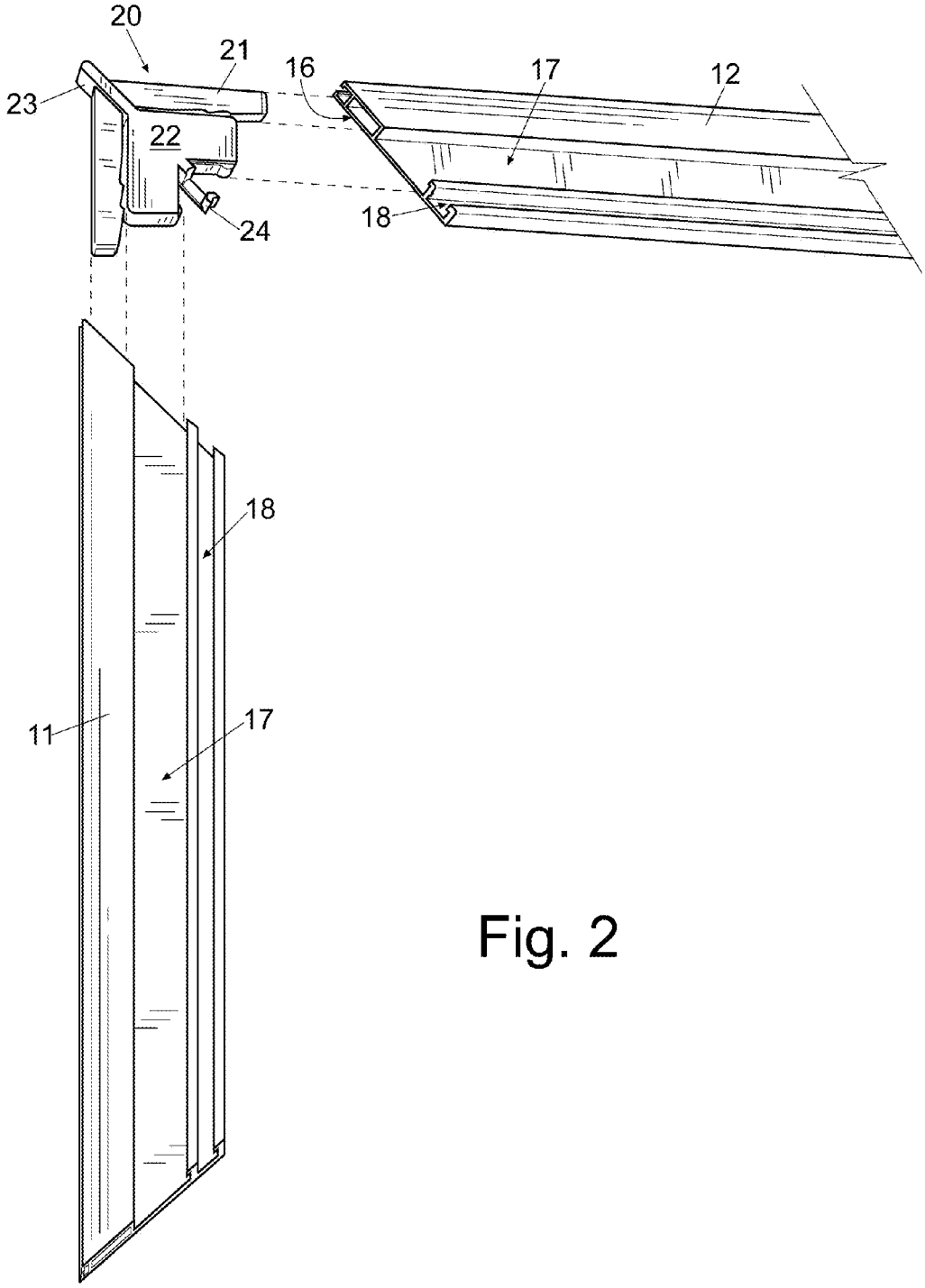
FIG. 2 is a partial rear exploded perspective view of two of the rails of the framed window screen and one corner connector.
Figure 3:
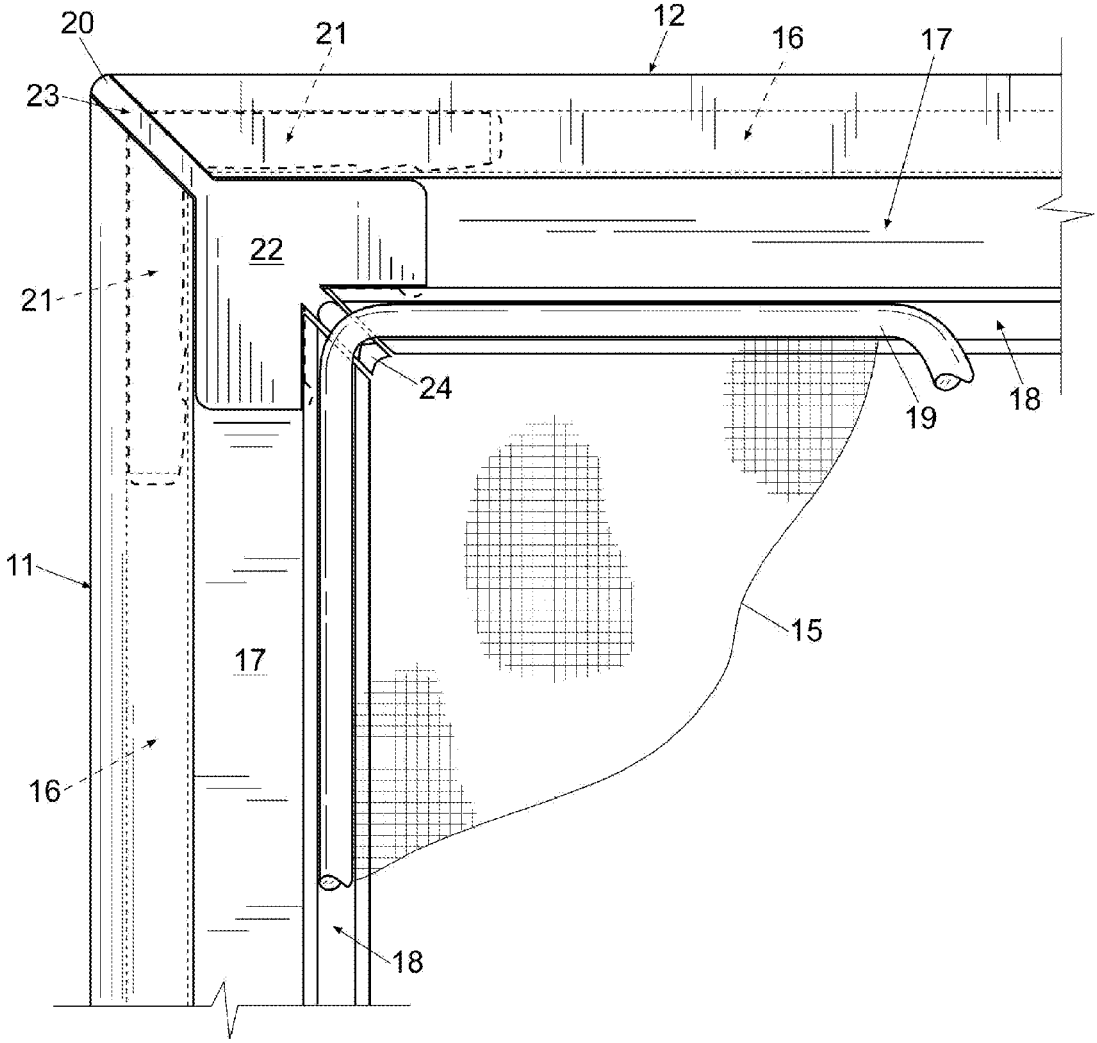
FIG. 3 is an enlarged rear view of one corner of the framed window screen as seen in FIG. 1.

Rails 11, 12, 13 and 14 are identical in construction with forty-five degree (45°) angled terminal ends and are sized for assembly for a particular window and as would be understood, can be formed in a variety of sizes (lengths/widths) for a particular size window as needed. Rails 11, 12, 13 and 14 are conventionally made of extruded aluminum and as shown in FIG. 2 each includes an outer channel 16, a large inner groove 17 and a small screen groove 18. Each end of rails 11, 12, 13 and 14 are cut at a forty-five degree (45°) angle as further shown in FIGS. 1, 2 and 3 to form a corner when joined together and accommodate connector 20 shown more clearly in FIGS. 4-9. Once all four (4) rails 11, 12, 13 and 14 are joined together by connectors 20 to form the frame, screen wire 15 is then positioned with the edges slightly overlapping screen groove 18. Thereafter a standard rubber seal 19 is typically "rolled" into screen groove 18 such as seen in FIG. 3 to contact and frictionally engage and hold screen wire 15 in place within groove 18 of rails 11, 12, 13 and 14 to form framed window screen 10.

Figure 4:
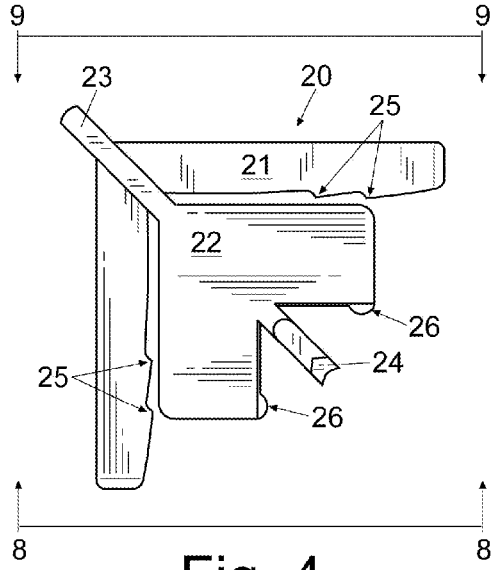
FIG. 4 is a rear elevational view of a corner connector.
Figure 5:
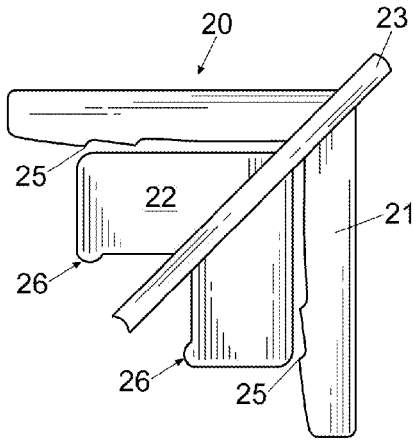
FIG. 5 is a front elevational view of the corner connector shown in FIG. 4.
Figure 6:
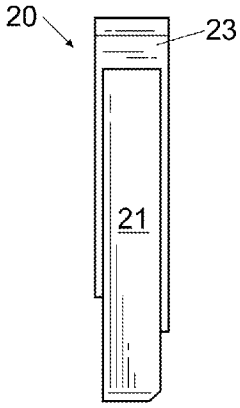
FIG. 6 is a left side elevational view of the corner connector shown in FIG. 4.
Figure 7:
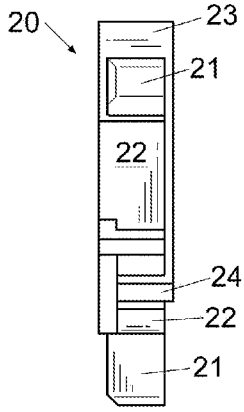
FIG. 7 is a right side elevational view of the corner connector shown in FIG. 4.
Figure 8:
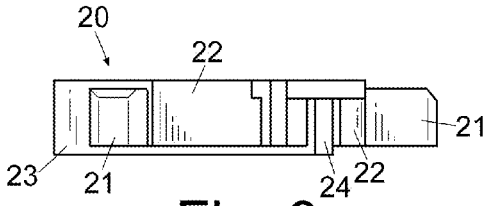
FIG. 8 is a bottom plan view of the corner connector as shown in FIG. 4 along lines 8-8.
Figure 9:
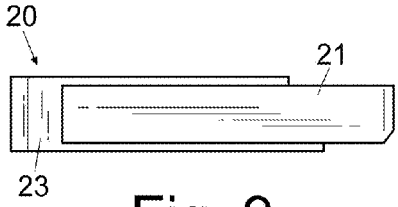
FIG. 9 is a top plan view of the corner connector shown in FIG. 4 along lines 9-9.
Figure 10:
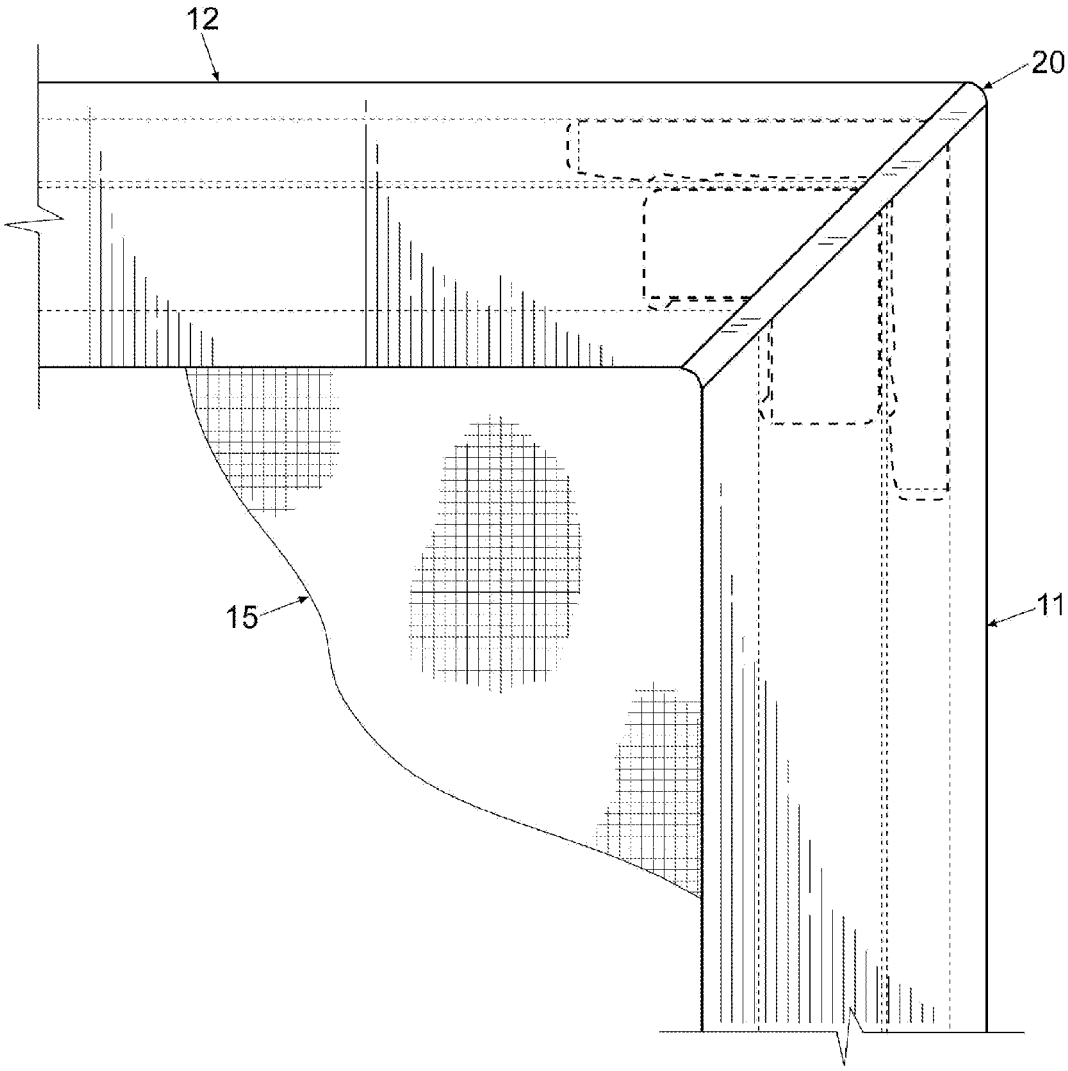
FIG. 10 is an enlarged front view of the corner of the framed window screen as seen in FIG. 3.

As seen in various views in FIGS. 4-9, connector 20 includes narrow L-shaped member 21 having teeth 25 and wider V-shaped groove support 22 having nibs 26 which are formed with and spaced along rib 23. Rib 23 is sized to provide a seamless connection between adjacent rails such as rails 11, 12 as shown in FIGS. 1, 3 and 10. As seen in FIGS. 2 and 4, rib 23 has stanchion 24 joined thereto at one end in opposing relation to L-shaped member 21 and is spaced from groove support 22. The space between stanchion 24 and V-shaped groove support 22 assists in providing a continuous groove between screen grooves 18 of rails 11, 12, 13 and 14 when joined together by connectors such as seen for example in FIG. 3. Stanchion 24 is contiguous screen grooves 18 and provides a seamless continuous edge for reception of screen wire 15 and rubber seal 19 within screen grooves 18 of rails 11, 12, 13 and 14. Connector 20 includes teeth 25 on L-shaped member 21 and nibs 26 on groove support 22 to increase the frictional engagement when in place with adjacent rails such as rails 11, 12 shown in FIG. 3.

Connector 20 is preferably formed by usual molding techniques from a rigid plastic material but could be formed from metal, composites or the like. As shown in FIG. 2, L-shaped member 21 with teeth 25 is inserted in channels 16 of first rail 11 and second rail 12 while V-shaped groove support 22 with nibs 26 is positioned in grooves 17 also illustrated in FIGS. 3, 10. V-shaped groove support 22 is wider than L-shaped member 21 and is sized to frictionally engage grooves 17 when connector 20 is joined with rails 11, 12, thereby increasing stability of the rail connection. With rails 11, 12, 13 and 14 joined with four (4) connectors 20 as seen in FIG. 1, screen wire 15 can be inserted in window screen frame 10 as is conventional by the use of rubber seal 19. Rib 23 of connector 20 also provides a seamless connection between rails 11, 12, 13 and 14 preventing gaps or spaces in the connection as demonstrated in FIGS. 1, 3 and 10.

When connector 20 is properly positioned, framed window screen 10 is more sturdy and is not as easily susceptible to damage, leaks or disassembly during manufacture, handling or installation. As groove supports 22 are positioned in grooves 17, adjacent window rails such as rails 11 and 12 cannot be easily rotated or twisted and providing improved integrity for framed window screen 10.

Figure 12:
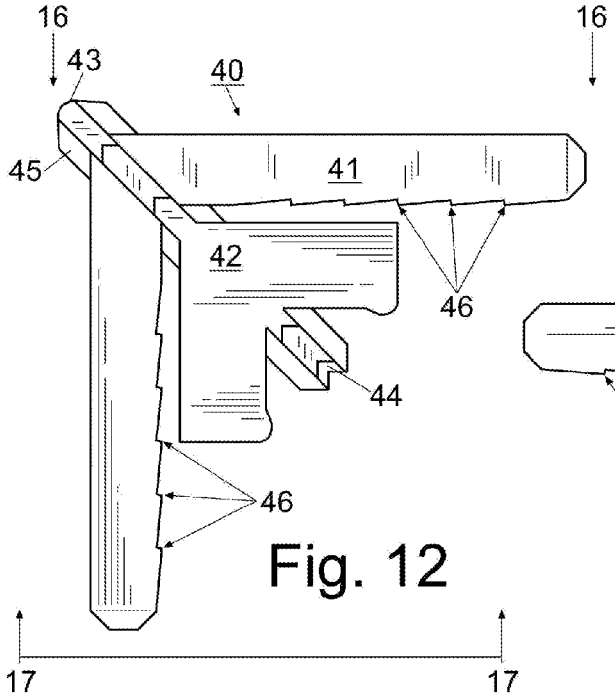
FIG. 12 is a rear elevational view of an alternate corner connector.
Figure 13:
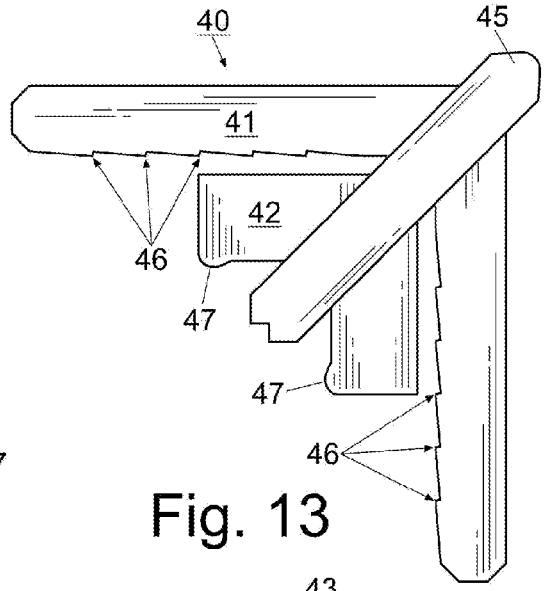
FIG. 13 is a front elevational view of the alternate corner connector shown in FIG. 12.
Figure 14:
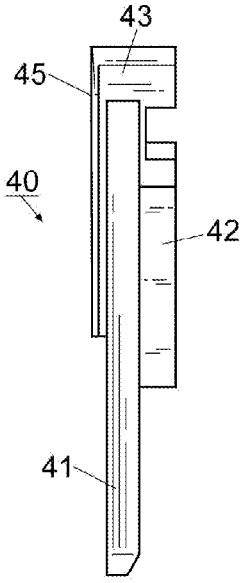
FIG. 14 is a left side elevational view of the alternate corner connector shown in FIG. 12.
Figure 15:
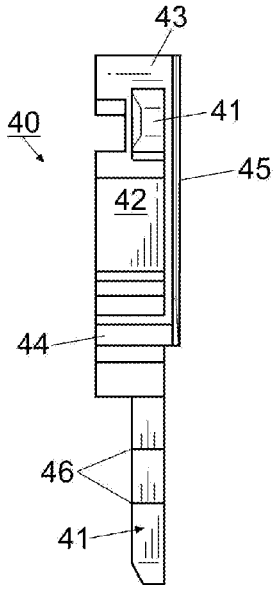
FIG. 15 is a right side elevational view of the alternate corner connector shown in FIG. 12.
Figure 16:
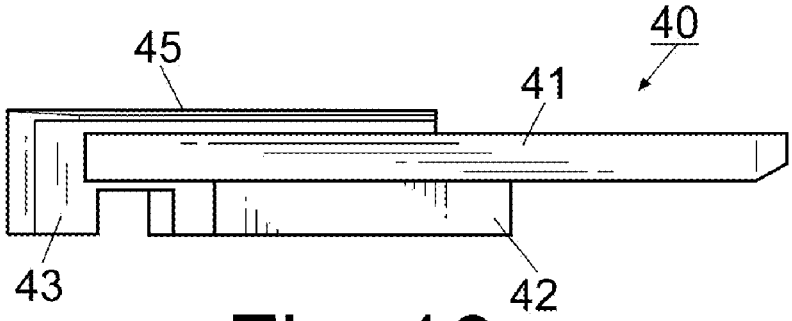
FIG. 16 is a top plan view of the alternate corner connector as shown in FIG. 12 along lines 16-16.
Figure 17:
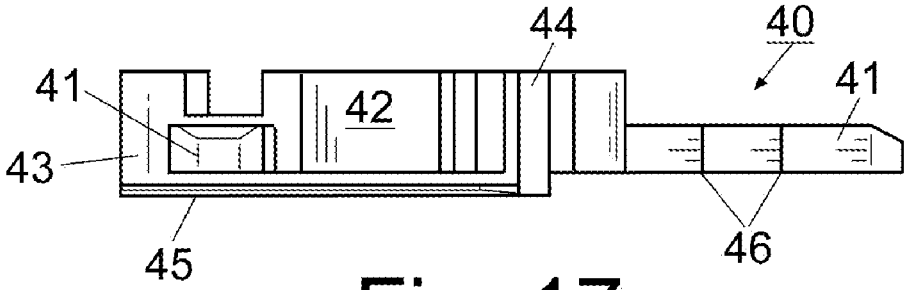
FIG. 17 is a bottom plan view of the alternate corner connector shown in FIG. 12 along lines 17-17.

Alternatively for aesthetic and other purposes, rib 23 can be formed on connector 40 with a "T-shape" such as seen in FIGS. 12-17. Rib top 45 is planar (FIGS. 14-17) and extends outwardly from rib 43 as seen in FIGS. 12 and 13 such that when rails 11, 12 are joined using connector 40, rib top 45 extends slightly over the edges of rails 11, 12 to "cover" or hide the joint between connector 40 and rails 11, 12. As seen in FIG. 13, rib top 45 is shaped on each end to complement the corner connection such as shown in FIGS. 3 and 10 by assembled framed window screen 10.

Corner connector 40 also includes elongated L-shaped member 41 having a plurality of teeth 46, V-shaped groove support 42 with nibs 47 and stanchion 44. L-shaped member 41 is longer than L-shaped member 21 and includes more teeth 46 whereby connector 40 could be used for the same size or larger framed window screens (not shown) and likewise provides strength and durability thereto.

Figure 11:
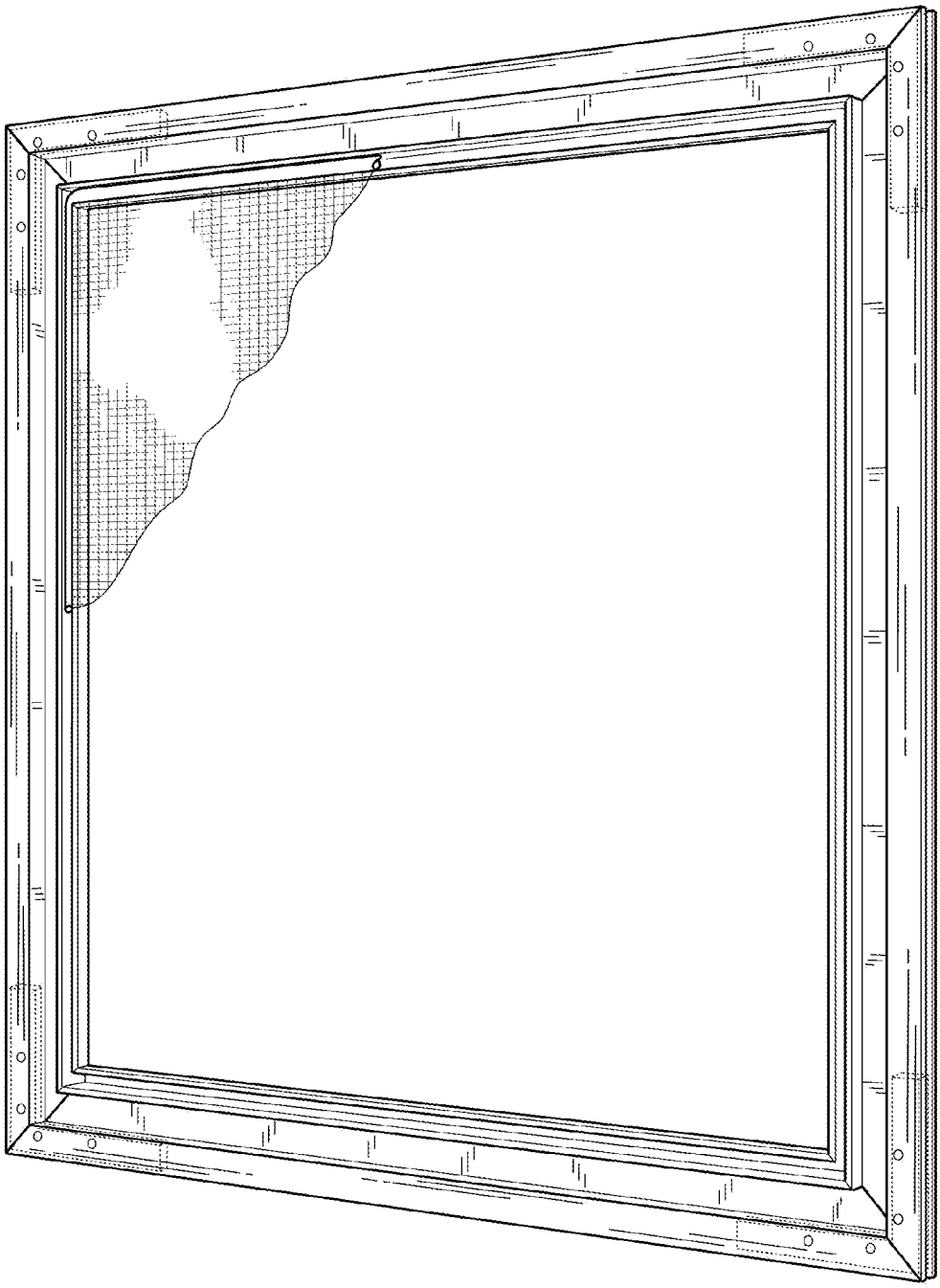
Fig. 11 Prior Art
FIG. 11 is a typical framed window screen with prior art corner connectors seen hidden in dashed line format.

In FIG. 11 a prior art window screen connector device is shown inserted in grooves 16 of a framed window screen but lacks the strength and durability provided by connectors 20 as grooves 17 are not supported.

The illustrations and examples provided herein are for explanatory purposes and are not intended to limit the scope of the appended claims.

I claim:

1. A light weight window screen frame comprising: a first rail, a second rail, said first rail and said second rail each defining 45° ends, a connector, said connector positioned between and separating said 45° ends and joining said first rail and said second rail, said connector comprising an L-shaped member, a groove support and a rib, said rib joined to said L-shaped member at a 45° angle and joined to said groove support, a stanchion, said stanchion joined to said rib in opposing relation to said L-shaped member for providing a continuous edge along said first rail and said second rail for reception of a screen and a seal by said first rail and said second rail, whereby said rib is between and parallel to said 45° ends of said first rail and said second rail.

2. The window screen frame of claim 1 further comprising a third rail, a fourth rail, said first rail, said second rail, said third rail and said fourth rail joined to form a rectangular frame.

3. The window screen frame of claim 2 wherein said first rail, said second rail, said third rail and said fourth rail each define a channel and a screen groove, said L-shaped member positioned in at least one of said rail channels.

4. The window screen frame of claim 2 wherein said first rail, said second rail, said third rail and said fourth rail each define a groove, said groove support positioned in at least one of said rail grooves.

5. The window screen frame of claim 2 wherein said first rail, said second rail, said third rail and said fourth rail each define a pair of grooves, said groove support positioned in at least one of said pair of rail grooves.

6. The connector of claim 1 formed from a polymeric material.

7. The connector of claim 1 wherein said groove support is V-shaped.

8. The connector of claim 1 wherein said groove support is spaced along said rib from said L-shaped member.

9. The connector of claim 1 wherein said groove support is wider than the width of said L-shaped member.

10. The connector of claim 1 wherein said rib is T-shaped.

11. The connector of claim 1 further comprising a plurality of teeth, said plurality of teeth positioned on said groove support for engaging said frame rails.

12. The connector of claim 11 further comprising a pair of nibs, said pair of nibs positioned on said groove support.

13. The connector of claim 1 further comprising a planar rib top, said rib top joined to said rib, said rib top extending over said frame rails.

* * * * *